US008727239B2

(12) United States Patent
Weis et al.

(10) Patent No.: US 8,727,239 B2
(45) Date of Patent: May 20, 2014

(54) PLUMBING OUTLET FITTING

(75) Inventors: Christoph Weis, Müllheim (DE); Hermann Grether, Müllheim (DE)

(73) Assignee: Neoperl GmbH, Mullheim (DE)

( * ) Notice: Subject to any disclaimer, the term of this patent is extended or adjusted under 35 U.S.C. 154(b) by 809 days.

(21) Appl. No.: 10/529,968

(22) PCT Filed: Aug. 8, 2003

(86) PCT No.: PCT/EP03/08842

§ 371 (c)(1),
(2), (4) Date: Mar. 31, 2005

(87) PCT Pub. No.: WO2004/038112

PCT Pub. Date: May 6, 2004

(65) Prior Publication Data

US 2006/0163386 A1 Jul. 27, 2006

(30) Foreign Application Priority Data

Oct. 22, 2002 (DE) ..... 102 49 340
Nov. 5, 2002 (DE) ..... 202 17 031

(51) Int. Cl.
*E03C 1/08* (2006.01)
*B05B 1/28* (2006.01)
*B05B 1/14* (2006.01)

(52) U.S. Cl.
USPC ..... 239/428.5; 239/288.5; 239/553.3; 239/590.5

(58) Field of Classification Search
USPC ..... 239/428.5, 288–288.5, 590.5, 553.3
See application file for complete search history.

(56) References Cited

U.S. PATENT DOCUMENTS

| | | | | | |
|---|---|---|---|---|---|
| 2,954,936 | A | * | 10/1960 | Shames et al. | 239/428.5 |
| 2,989,249 | A | * | 6/1961 | Richter | 239/427 |
| 3,110,445 | A | * | 11/1963 | Benjamin et al. | 239/428.5 |
| 3,223,045 | A | | 12/1965 | Shope | |
| 3,227,380 | A | * | 1/1966 | Pinkston | 239/427 |
| 3,286,935 | A | * | 11/1966 | Corlett et al. | 239/428.5 |
| 3,291,064 | A | | 12/1966 | Foster | |
| 3,635,405 | A | | 1/1972 | Shames et al. | |
| 3,682,392 | A | * | 8/1972 | Kint | 239/428.5 |
| 3,684,191 | A | | 8/1972 | Shames et al. | |

(Continued)

FOREIGN PATENT DOCUMENTS

| | | |
|---|---|---|
| CH | 380 042 | 8/1964 |
| DE | 1 910 493 | 2/1965 |

(Continued)

*Primary Examiner* — Len Tran
*Assistant Examiner* — Steven M Cernoch
(74) *Attorney, Agent, or Firm* — Crowell & Moring LLP

(57) ABSTRACT

A plumbing outlet fitting (2) with a liquid guide (3), which opens into a fitting outlet (4) in an area in which a plumbing functional unit (5) in the form of an insertion cartridge is provided. The outlet fitting is provided such that the clear open cross-section of the liquid guide (3) is adapted to the insertion cartridge (5) at least in the opening area of the fitting outlet (4), and the insertion cartridge (5) can be inserted into the fitting outlet (4) from the opening side and is removably held therein, The outlet fitting (2) can be used with a jet regulator or with another plumbing functional unit (5) without any significant limitations of the structural clearance.

27 Claims, 7 Drawing Sheets

(56) References Cited

U.S. PATENT DOCUMENTS

| | | | | | |
|---|---|---|---|---|---|
| 4,365,755 | A | * | 12/1982 | Aghnides | 239/428.5 |
| 4,403,739 | A | | 9/1983 | Knapp et al. | |
| 4,470,546 | A | * | 9/1984 | Wildfang | 239/428.5 |
| 4,530,467 | A | | 7/1985 | Bueno | |
| 4,534,513 | A | * | 8/1985 | Aghnides | 239/428.5 |
| 4,534,514 | A | * | 8/1985 | Aghnides | 239/428.5 |
| 4,562,960 | A | | 1/1986 | Marty et al. | |
| 4,722,509 | A | | 2/1988 | Delker et al. | |
| 5,071,071 | A | | 12/1991 | Chao | |
| 5,467,929 | A | | 11/1995 | Bosio | |
| 5,495,985 | A | | 3/1996 | Nehm et al. | |
| 5,769,326 | A | * | 6/1998 | Muchenberger et al. | 239/428.5 |
| 5,803,368 | A | * | 9/1998 | Shekalim | 239/428.5 |
| 5,943,711 | A | | 8/1999 | Loizeaux et al. | |
| 6,029,912 | A | | 2/2000 | Woolley | |
| 6,126,093 | A | | 10/2000 | Grether et al. | |
| 6,152,182 | A | | 11/2000 | Grether et al. | |
| 6,249,921 | B1 | | 6/2001 | Daniel et al. | |
| 6,409,100 | B1 | * | 6/2002 | Lundberg | 239/428.5 |
| 6,513,731 | B2 | * | 2/2003 | Griffin et al. | 239/394 |
| 2002/0079471 | A1 | | 6/2002 | Shen | |
| 2002/0084353 | A1 | * | 7/2002 | Griffin et al. | 239/428.5 |

FOREIGN PATENT DOCUMENTS

| | | |
|---|---|---|
| DE | 35 09 666 | 9/1986 |
| DE | 38 35 143 | 4/1990 |
| DE | 40 39 337 | 7/1991 |
| DE | 198 05 691 | 8/1999 |
| DE | 198 51 151 | 5/2000 |
| FR | 2 576 939 | 8/1986 |

* cited by examiner

PLUMBING OUTLET FITTING

The present invention relates to a sanitary outflow armature having a liquid guide that opens into a fitting outlet, in the area of which a plumbing functional unit in the form of an insertion cartridge is provided, wherein the clear cross-section of the opening of the liquid guide being adapted to the insertion cartridge at least in the opening area of the fitting outlet, and the insertion cartridge being capable of being inserted into the fitting outlet from the opening side and being held removably therein.

BACKGROUND

Various jet regulators have been created that are provided as plumbing functional units in the area of the fitting outlet of a sanitary outflow armature, and that are used to produce a soft, non-spraying jet of water. The known jet regulators can regularly be inserted into a sleeve-shaped outlet nozzle that can be screwed onto the end of the fitting outlet.

However, the use of a sleeve-shaped outlet nozzle that is to be screwed onto the fitting outlet requires an expensive machining of the outlet fitting, and, in addition, limits the structural clearance in the design of such an outlet fitting. In addition, the outlet nozzle, manufactured as a separate metal collar, usually chromed, results in significant additional costs.

In particular in high-quality fittings, which must also satisfy high aesthetic demands, the fitting and the associated nozzle must be jointly ground, polished, and subsequently chromed or painted together, at high expense, in order to achieve the smoothest possible transition between the fitting and the nozzle without color deviations and without disturbing gaps, and in order to ensure that the diameter is identical. The gaps that are standard with the use of conventional nozzles between the fitting and the nozzle that screws onto the outlet end of the fitting can not only disturb the optical appearance of such a fitting, but can also form a flaw from a hygienic point of view due to the collection of dirt.

From CH-A-380 042, a plumbing outlet fitting of the type named above is known in whose opening area a jet regulator in the form of an insert cartridge is provided. The clear opening of the opening area of the plumbing outlet fitting is adapted to the insertion cartridge in such a way that this cartridge can be inserted from the opening side into the fitting outlet in removable fashion. The peripheral wall at the opening side of the insertion cartridge has a hexagonal outer shape onto which a socket wrench can be placed for grasping and screwing on. The jet regulator, in the form of an insertion cartridge, can be inserted into the fitting outlet up to an insertion stop, and an axial annular seal is provided between the insertion stop and the adjacent end surface of the insertion cartridge.

The outlet fitting known from CH-A-380 042 does indeed make it possible to do away with an additional chromed metal collar and the expense connected therewith. However, in order to create the insertion stop required for the axial seal in the interior of the tube of the plumbing outlet fitting, a comparatively thick tube is required that has to be milled out in the opening area, or the later addition of a corresponding annular flange, and thus also an additional significant manufacturing expense, is required.

SUMMARY

Therefore, the object arises in particular of creating a sanitary outflow armature that can be used with a jet regulator or with another plumbing functional unit without essential limitation of the structural clearance, and which is nonetheless distinguished by a comparatively low manufacturing cost.

In a plumbing outlet fitting of the type named above, the solution according to the present invention of this problem is in particular that the insertion cartridge is sealed radially in peripheral fashion against an intermediate holder or against the inner peripheral wall of the fitting outlet, and/or that the intermediate holder is sealed radially in peripheral fashion against the inner peripheral wall of the outlet fitting.

The functional unit, in the form of an insertion cartridge, can be inserted into the fitting outlet from the opening side and is held therein in removable fashion. For the acceptance of this insertion cartridge, the inner diameter of the liquid guide of the outlet fitting is adapted to the insertion cartridge at least in the area of the opening of the fitting outlet. Thus, an outlet nozzle, and its additional significant costs, can be omitted; up to now, such nozzles have been associated with an overly high portion of the overall costs of an outlet fitting. Because the screwing on of such an outlet nozzle can be omitted, and because such an outlet nozzle also does not have to be processed together with the outlet fitting for color matching, the manufacture of the sanitary outflow armature is simplified significantly. The expense connected with the manufacture of the outlet fitting according to the present invention is however also significantly reduced in that the insertion cartridge is sealed radially in peripheral fashion against the intermediate holder or against the inner peripheral wall of the outlet fitting, and/or that the intermediate holder is sealed radially in peripheral fashion against the inner peripheral wall of the fitting outlet. Due to this radial seal, an insertion stop or similar sealing flange required in the case of an axial seal can be omitted, which otherwise would have to be created, at a considerable manufacturing expense, by milling out a correspondingly thick tube piece or by the later insertion of an annular flange, and made in the opening area of the outlet fitting. Because a nozzle can be omitted, the gap that is typically present between the nozzle and the outlet fitting when conventional nozzles are used, and that has a disturbing optical effect and conflicts with desirable hygienic goals, can be avoided. The plumbing functional unit is held removably in the fitting outlet of the sanitary outflow armature, and can thus easily be detached and removed even by unskilled users for service work, such as for example the removal of dirt or for decalcification. The omission of an outlet nozzle also increases the structural clearance in the design of an outlet fitting, so that for example it is also possible to use colored outlet fittings without having to manufacture special nozzles having the corresponding color, at additional cost.

It is useful if the insertion cartridge is situated in the fitting outlet with at least the predominant part of its longitudinal extension, preferably with its complete longitudinal extension. If the insertion cartridge is situated in the fitting outlet with its entire longitudinal extension, it can be housed in the fitting outlet so as to be hidden, i.e., practically invisible from the outside, and secure against manipulation. From there, the insertion cartridge can be detached for example with the aid of a crown key or an open wrench, or some other removal tool.

The insertion cartridge can be held immediately in the fitting outlet without additional adapters. Another specific embodiment according to the present invention provides that the insertion cartridge is held in the fitting outlet by means of a preferably sleeve-shaped intermediate holder.

In order to facilitate the installation of the insertion cartridge in the fitting outlet and to determine the position of the insertion cartridge there, it is useful if the insertion cartridge or the intermediate holder can be inserted into the fitting outlet up to an insertion stop.

Here it is possible for the intermediate holder, which can be inserted into the fitting outlet from the opening side, to be held in the fitting outlet in removable or in non-removable fashion.

It is advantageous if the intermediate holder is held in the fitting outlet by means of a glued connection, a clamp connection, a locking connection, and/or a screw connection, and/or through pressing, clutching, or wedging.

Here it is advantageous if the intermediate holder is sealed against the inner peripheral wall of the fitting outlet, preferably around the complete periphery. The sealing of the intermediate holder in the outlet fitting can take place by means of additional seals, such as for example an O-ring or a flat seal, seals formed onto the intermediate holder, or with the aid of connecting means, for example the adhesive means used in the gluing of the intermediate holder.

It is advantageous if the insertion cartridge is held in the fitting outlet or in the intermediate holder by means of a clamp connection, a locking connection, or a screw connection. Thus, the insertion cartridge can for example be held in the outlet fitting or the intermediate holder by a one-threaded or multi-threaded screw connection, or by snap connections; removable connections of this sort enable a rapid and simple assembly and disassembly of the functional unit as needed.

It is useful if the insertion cartridge is also sealed against the intermediate holder or against the inner peripheral wall of the fitting outlet. Such a sealing of the functional unit against the intermediate holder or against the inner peripheral wall of the fitting outlet can for example take place by means of an O-ring, a flat seal, or other known seals.

A preferred specific embodiment according to the present invention provides that at least one annular seal, preferably at least one O-ring, is provided for the sealing between the insertion cartridge and/or the intermediate holder on the one hand and the outlet fitting on the other hand.

According to a further development of the present invention, it is provided that the insertion cartridge or the intermediate holder bears an outer thread that can be screwed into an inner threading in the fitting outlet, and that the outer thread and the inner thread are dimensioned and situated such that when the insertion cartridge and/or the intermediate holder are screwed onto one another, the threads grasp one another in a relative position of the outlet fitting on the one hand and the insertion cartridge and/or intermediate holder on the other hand in which the O-ring, or similar annular seal, provided on the outer periphery of the insertion cartridge or of the intermediate holder does not yet make frictional contact with the outlet fitting. Through the situation of the annular seal, which seals the insertion cartridge radially in the fitting housing, during assembly and disassembly a clear advantage can be made use of: during assembly, there is a significantly greater feeling for finding the threads, because the annular seal is not pressed radially until the thread has already been found. The pressing of the annular seal produces a large amount of friction, which would otherwise make the feeling for the assembly significantly more difficult. During disassembly, the selected situation of the annular seal has the advantage that the insertion cartridge is rotated out of the screwed connection with the fitting outlet with the aid of the insertion and removal tool. As long as the annular seal is still in the pressed state, there is a forced axial movement through the threading. The threading does not come out of engagement until the annular seal has left the fitting seat in the axial direction. This has the decisive advantage that the functional unit, constructed as a hidden insertion cartridge and assembled with an intermediate holder if necessary, can be removed from the fitting completely by rotational movement, without requiring either additional axial drawing due to the influence of friction or the support of water pressure.

However, it is also possible for at least one peripheral seal to be formed in one piece onto the insertion cartridge; here, in the sealing region the insertion cartridge can be constructed not only as a multi-component injection-molded part, but in particular also as a single-component injection-molded part.

A particularly advantageous development according to the present invention, warranting separate protection, therefore provides that the insertion cartridge and/or the intermediate holder are connected in one piece with at least one peripheral seal between the insertion cartridge and/or the intermediate holder on the one hand and the outlet fitting on the other hand. The one-piece formed-on seal, provided on the insertion cartridge and/or on the intermediate holder, prevents creeping or leakage currents of the liquid, etc., flowing through the outlet fitting between the insertion cartridge and/or the intermediate holder on the one hand and the outlet fitting on the other hand.

It can be advantageous if the final edge region at the flow inlet side of the insertion cartridge and/or of the intermediate holder is constructed as a sealing profile. Such a design can also be constructed with a comparatively broad final edge without excessive limitation of the inner external cross-section. This comparatively broad final edge on the insertion cartridge and/or on the intermediate holder can subsequently be used very successfully to form a comparatively complex sealing profile.

In the realization of the sealing profile, it is useful if the sealing profile has at least one surface seal and/or at least one lip seal. These shapes of the sealing profile can form an effective seal together with the counterstop of the outlet fitting if the sealing profile contacts the counterstop, thus exerting a linear and/or surface pressure on the sealing profile.

In order to prevent excessive deformation of the sealing profile, it is useful if the insertion cartridge and/or the intermediate holder have at the flow inlet side an insertion stop that, in its position of use, limits a deformation of the sealing profile. Otherwise, the sealing profile could be damaged or excessively deformed, which could lead to leakage in the area between the insertion cartridge and/or the intermediate holder and the outlet fitting, and thus to corresponding creeping currents.

In the formation of the sealing profile, it is advantageous if the sealing profile has at least one seal having a sealing profile base that is constructed as an insertion stop. The sealing profile can here be situated on the upper limiting surface of the sealing profile base. The insertion stop can act to limit, for example, the screw-in depth, if the insertion cartridge or the intermediate holder is fastened on the fitting via a screw connection. If the screwing is taking place manually without the use of a tool, the insertion stop can transmit a feeling of solidity of the screwed connection, in that the contact of the counterstop against the fitting can be felt through the insertion stop.

In order to enable the use of as large a surface as possible of the inner diameter of the insertion cartridge and/or the intermediate holder, or to avoid unnecessary narrowing of the inner diameter, it is useful if the sealing profile, and, if necessary, its insertion stop, works together with a final edge area of the outlet fitting that limits the inner diameter, said final edge area simultaneously acting as a counterstop for the insertion cartridge and/or the intermediate holder.

Here, for the functioning of the insertion stop it is particularly advantageous if the insertion stop is situated so as to be adjacent to the sealing profile in the radial direction. In this way, the insertion stop can receive precisely those forces that could possibly damage the sealing profile. Moreover, in this way a space-saving situation of the insertion stop and of the sealing profile on the inner diameter of the jet regulator can be achieved.

A simple and nonetheless effective sealing construction of the sealing profile is achieved if the sealing profile has at least one annular peripheral sealing lip. This sealing lip can either be constructed in elastic, flexible fashion, thereby being adapted to the counterstop in the outlet fitting during the fastening of the insertion cartridge and/or the intermediate holder, or the sealing lip can be fashioned in such a way that deformation is possible only with difficulty, so that during the fastening the sealing lip achieves a seal only through a surface pressure by the counterstop of the outlet fitting. These two possibilities can be combined with a plurality of sealing lips in various ways.

A particularly advantageous construction of the sealing profile provides that the sealing profile has at least two annular peripheral sealing lips that become effective one after the other with increasing insertion pressure acting on the jet regulator. This stepped construction of the sealing profile can have the effect that in the case of failure of one sealing lip, the adjacent sealing lips of the sealing profile become effective. Moreover, by tightening the component screwed onto the outlet fitting, i.e., the insertion cartridge and/or the intermediate holder, an insertion pressure is exerted in such a way that at least additional sealing of the sealing profile can also become effective.

A further construction with annular peripheral sealing lips that become effective one after the other provides that these sealing lips have different heights. In this way, after longer use of the insertion cartridge and/or of the intermediate holder it is possible to maintain the sealing effect for a long period of time by tightening the component screwed onto the outlet fitting. If the highest sealing lip is already somewhat damaged or worn or has become inflexible, the next-highest sealing lip can again achieve the sealing effect after further tightening. Moreover, small unevenness of the counterstop of the outlet fitting can be compensated. Here, it can be advantageous if the sealing lips have stepped heights, and if the highest sealing lip forms the innermost or outermost seal of the sealing profile.

It is possible for the component of the insertion cartridge and/or of the intermediate holder having the seal to be manufactured as a multi-component injection-molded part, and for this component to be made of a flexible and/or elastic material in the area of the at least one seal. For the simple recycling of the material that forms the insertion cartridge and/or the intermediate holder, it is however useful if the seal and the component, connected with it in one piece, of the insertion cartridge and/or of the intermediate holder are manufactured from the same, preferably food-safe, material. This can simplify the manufacturing outlay, and the tool costs for an injection-molding tool that may be required can be kept comparatively low.

A preferred development according to the present invention provides that the plumbing functional unit is fashioned as a jet regulator.

Additional features of the present invention result from the following description of exemplary embodiments according to the present invention, in connection with the claims and the drawings. The individual features can be realized individually or in combination in a specific embodiment according to the present invention.

BRIEF DESCRIPTION OF THE DRAWINGS

Shown are.

DETAILED DESCRIPTION OF THE PREFERRED EMBODIMENTS

Figure 1:
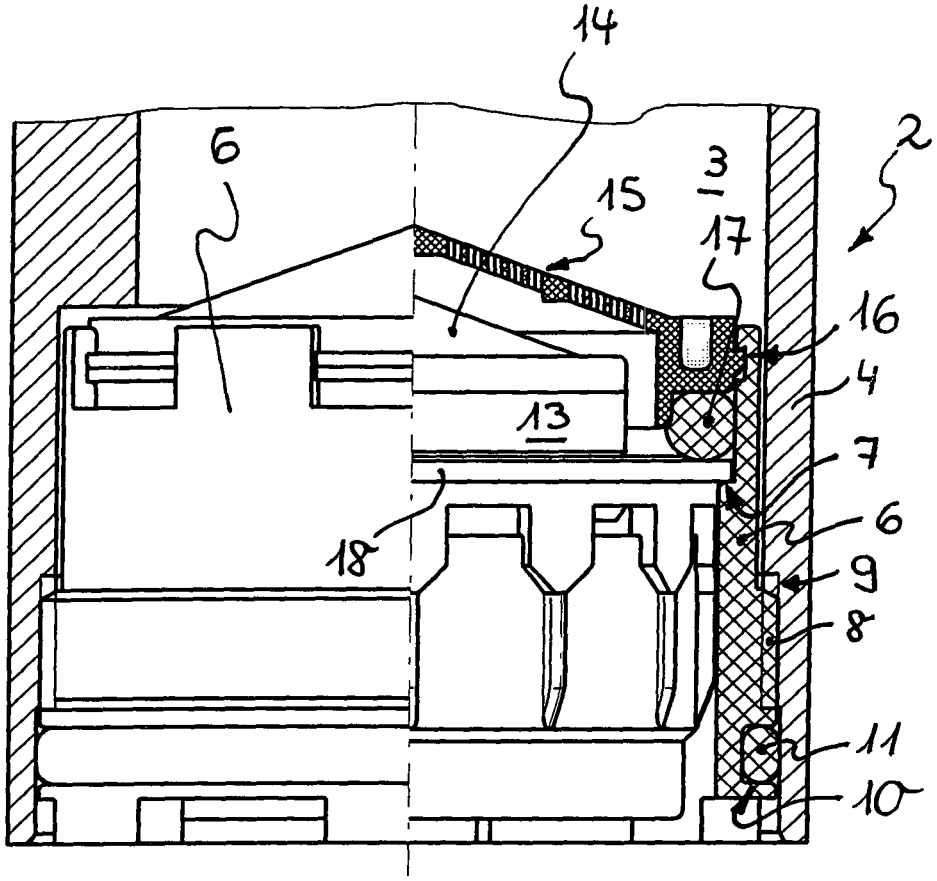
FIG. 1 shows a plumbing outlet fitting in whose fitting outlet a plumbing functional unit formed as an insertion cartridge can be inserted in removable fashion by means of an intermediate holder.

FIG. 1 shows a plumbing outlet fitting 2 in the area of the fitting outlet 4 of its liquid guide 3. In the area of the fitting outlet 4, a plumbing functional unit in the form of an insertion cartridge 5 is provided that is held in fitting outlet 4 via a sleeve-shaped intermediate holder 6. The insertion cartridge 5 can be inserted into the intermediate holder 6 from the opening side of the intermediate holder 6 up to a holding projection 7. The outlet fitting 1, 2 and is held removably therein, and that the insertion cartridge 5 is here situated completely and with its entire longitudinal extension in the fitting outlet 4 so as to be practically invisible.

Figure 2:
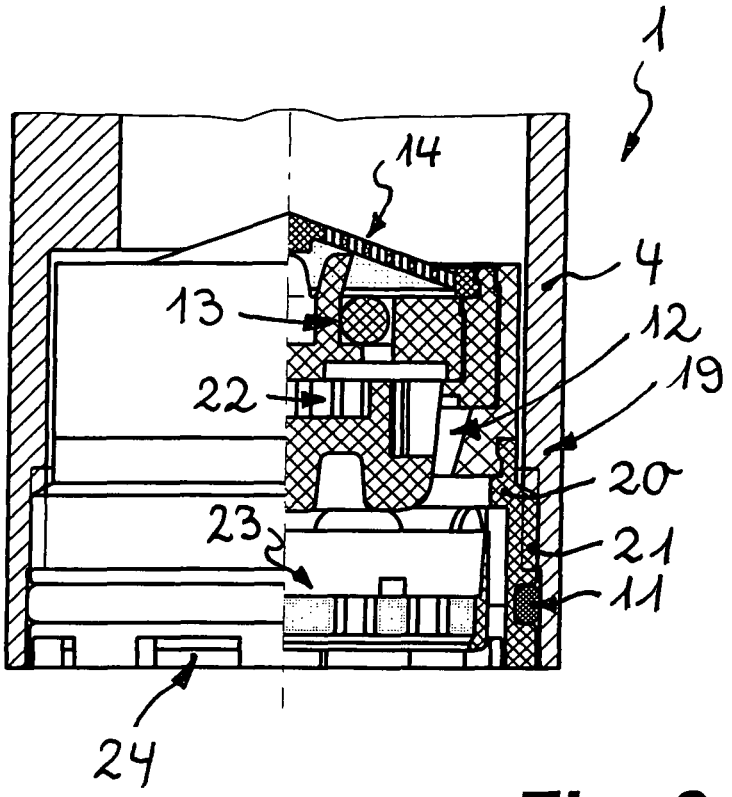
FIG. 2 shows a plumbing outlet fitting in which the plumbing functional unit in the form of an insertion cartridge can be removably inserted into the fitting outlet without an intermediate holder.

While the insertion cartridge 5 of the outlet fitting 1 shown in FIG. 1 can be placed immediately into the fitting outlet 4, the insertion cartridge 5 of the outlet fitting 2 shown in FIG. 2 is held immediately in the fitting outlet 4 by a sleeve-shaped or cup-shaped intermediate holder 6.

This intermediate holder 6 can be fastened removably or non-removably in the fitting outlet 4. Here it is possible to fasten the intermediate holder 6 in the fitting outlet 4 for example by means of a clamped connection, a locking connection, and/or a screw connection. If the intermediate holder 6 is glued in the fitting outlet 4, the adhesive used can simultaneously be used as a sealing means for sealing the intermediate holder 6 against the inner peripheral wall of the fitting outlet 4. In such a specific embodiment, in which the intermediate holder 6 is fastened non-removably in the outlet fitting 2, the intermediate holder 6 can easily be placed into the outlet fitting 2 by the manufacturer of the fitting, so that it will subsequently remain therein for the entire life span of the outlet fitting 2. The insertion cartridge 5 is also fastened removably in the intermediate holder 6 in the outlet fitting 2, so that the user can easily remove it from the outlet fitting 2 as needed, for example for service work for the removal of dirt or for decalcification.

The outlet fittings 1, 2 shown here can be manufactured without a great outlay and at relatively low cost. As can be seen from FIG. 2, a special machining of a fitting outlet intended to receive the intermediate holder 6 can be omitted. An additional cost reduction is achieved in that the outlet nozzles previously required are omitted.

In FIGS. 1 and 2, it is shown that the machining of the outlet fitting in the area of the fitting outlet intended for the reception of the plumbing functional unit can be accomplished for example by the formation of a simple blind hole, or a blind hole having a simple holding geometry, for example a groove. Given a corresponding construction of the holding mechanism provided between the functional unit 5 and the outlet fitting 1, 2, it may be possible to entirely omit a machining of the outlet fitting.

The fastening of the intermediate holder 6 in the fitting outlet 4 can take place for example by means of pressing, gluing, snapping, clutching, or wedging. The sealing of the intermediate holder 6 in the fitting outlet 4 can for example be accomplished with additional seals, such as an O-ring or a flat seal, with seals sprayed onto intermediate holder 6, or through the above-named connecting means, such as for example the adhesive used in gluing.

In FIGS. 1 and 2, it can be seen that the insertion cartridge 5 is here fastened removably in the outlet fittings 1, 2 by means of a screw connection. For the fastening of the insertion cartridges, a number of variations are possible, such as for example single-threaded or multi-threaded screw connections, snap connections, or other removable connections that enable simple assembly and disassembly.

In the outlet fitting shown in FIG. 1, the insertion cartridge 5 is held directly in the opening area of the fitting outlet 4, without the interposition of an intermediate holder 6. The outlet fitting 1 shown in FIG. 1 has for this purpose an inner threading in the area of its fitting outlet 4, into which the insertion cartridge 5 can be screwed from the opening side. Here, the insertion cartridge 5, formed as a jet regulator insert, can for example be screwed tight using a crown key that engages on the outer contour of the insertion cartridge between the longitudinal webs. An assembly and disassembly of the insertion cartridge 5 intended for the outlet fittings 1, 2 can also be accomplished using standardized or special tools that can be used on the lower end surface of the insertion cartridge 5 in order for example to screw the insertion cartridge into the outlet fittings 1, 2.

Figure 3:
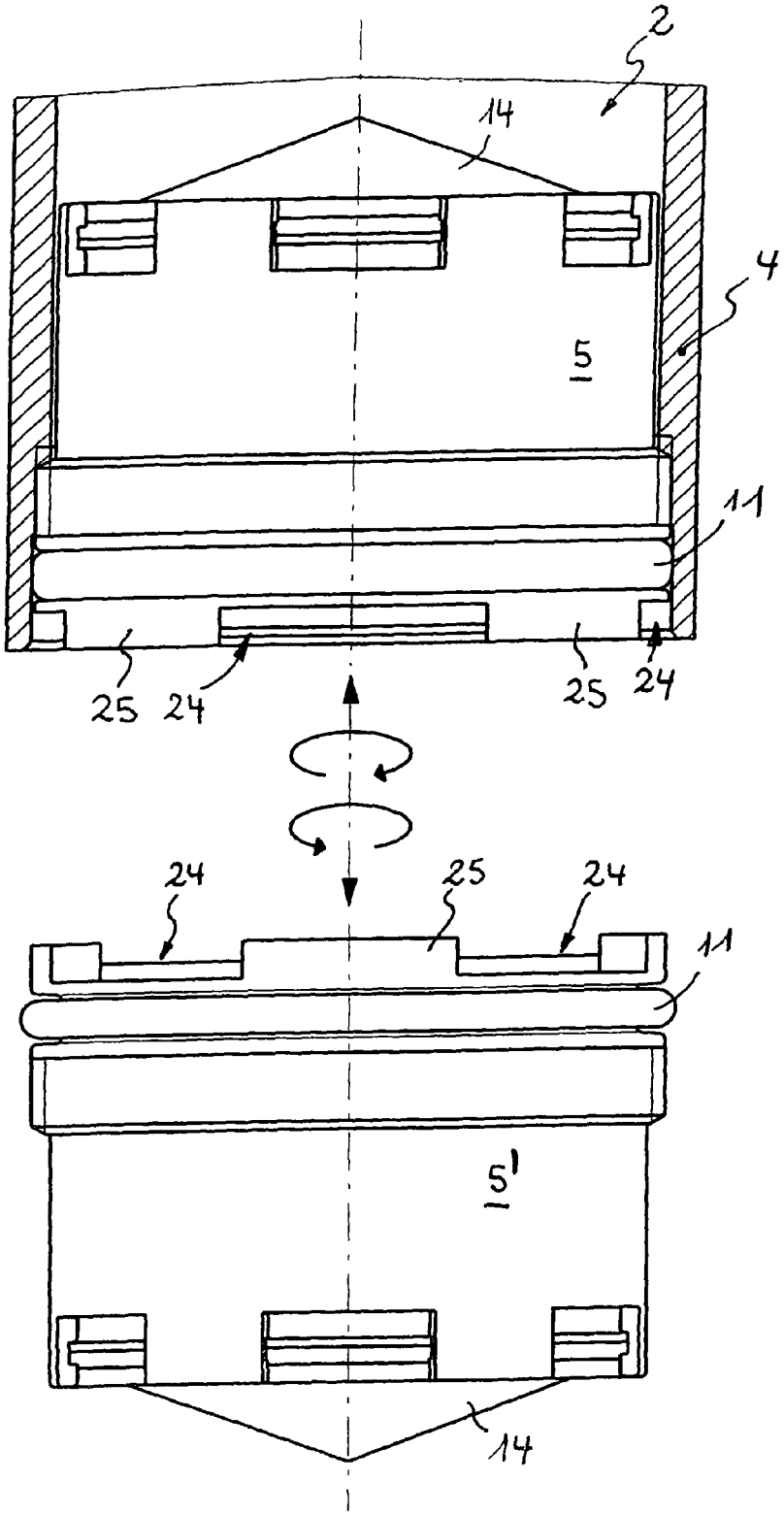
FIG. 3 shows a plumbing outlet fitting having an insertion cartridge that can be inserted into the fitting outlet, in which an additional, identically constructed insertion cartridge, provided for exchange, can be used to screw the insertion cartridge in and out of the fitting outlet.

In FIG. 3, a sanitary outflow armature 2 is shown in the area of the fitting outlet 4 of its liquid guide 3. In the area of the fitting outlet 4, a plumbing functional unit, in the form of an insertion cartridge 5, is provided that is held in the fitting outlet 4 via a sleeve-shaped intermediate holder 6. The insertion cartridge 5 can be placed into the intermediate holder 6 from the flow inlet side of the intermediate holder 6, up to a holding projection 7.

The intermediate holder 6 has on its outflow-side peripheral edge area an outer thread 8 that can be screwed into a complementary inner thread in the fitting outlet 4 in such a way that the intermediate holder 6, and the insertion cartridge 5 situated therein, are situated completely in the fitting outlet 4 with their entire longitudinal extension.

At the side facing away from the direction of flow of the outer threading 8, on the periphery of the intermediate holder, an annular seal 11, held in an annular groove 10, is provided that provides a seal in the radial direction between the intermediate holder 6 and the inner periphery of outlet fitting 1. Here, the insertion cartridge 5 is formed from a jet regulator 12 at the flow outlet side, that is connected, preferably in removable fashion, at the flow inlet side with a flow regulator 13 as well as with a sieve attachment 14 that is connected upstream.

At the flow inlet side of the intermediate holder 6, an additional sieve attachment 15 is provided that can extend over a comparatively large cross-section inside liquid guide 3 of the outlet fitting 2. The sieve attachment 15 is connected in removable fashion with the intermediate holder 6, and has for this purpose a peripheral locking projection 16 on its peripheral edge that engages in an annular groove on the inner periphery at the flow inlet side of the intermediate holder 6. Between the sieve attachment 15 and an end surface at the flow inlet side of the jet regulator 12 of the insertion cartridge 5, an annular seal 17 that seals in the axial direction is provided; the jet regulator 12 is held between a holding projection 7 and the sieve attachment 15 with an annular flange 18. Functional units of standard construction, such as for example a jet regulator, flow regulator, backflow prevention device, and/or sieve attachment, can be inserted into the intermediate holder 6.

Figure 4:
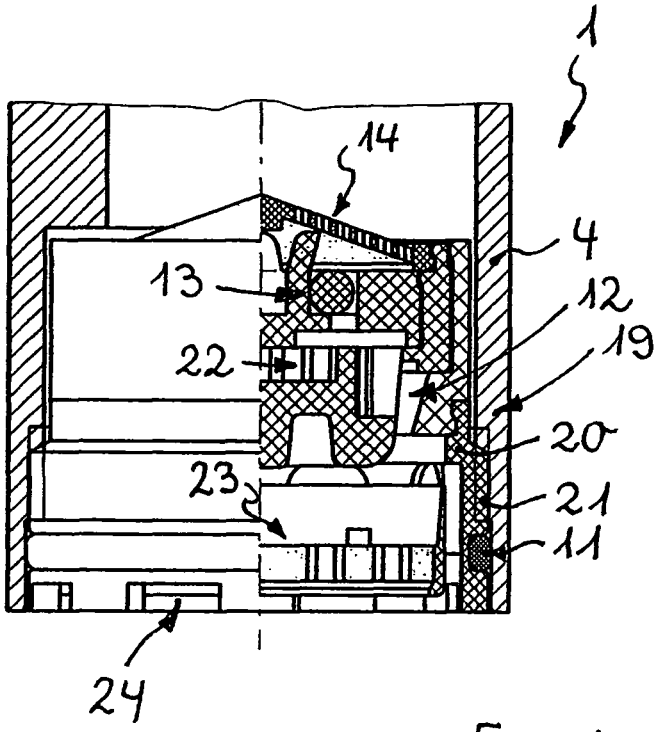
FIG. 4 shows a plumbing outlet fitting in which the plumbing functional unit, in the form of an insertion cartridge, can be placed removably into the fitting outlet without an intermediate holder.

FIG. 4 shows a sanitary outflow armature 1 into whose outlet end a plumbing functional unit, in the form of an insertion cartridge 5, can also be inserted without an intermediate holder. For this purpose, the insertion cartridge 5 has a multi-part cartridge housing 19, here constructed in two parts, having an outer threading 21 on a housing part 20 at the flow outlet side. The insertion cartridge 5 can be screwed with this outer threading 21 onto an inner threading that is situated on the inner periphery of the liquid guide 3 provided at the outflow end of the outlet fitting 1. An annular seal 11 is also provided on the housing part 20, on the side of outer threading 21 facing away in the direction of flow; this annular seal is situated in an annular groove on the outer periphery of the cartridge housing 19.

The insertion cartridge 5 in FIG. 4 is also situated with its entire longitudinal extension essentially completely in the fitting outlet 4. The insertion cartridge 5 also has an outflow-side jet regulator 12 having a jet fractionator 22 and a subsequent jet regulating device 23. The jet regulator 12 is connected at the flow outlet side with a flow regulator 13, and a sieve attachment 14 is connected upstream from flow regulator 13.

Due to the multi-part construction of the cartridge housing 19, the insertion cartridge 5 in FIG. 4 has a modular construction. While the housing part 20 enables the installation of the insertion cartridge in an outlet fitting 1 even without the intermediate holder 6 and without a nozzle, alternatively an additional housing part (not shown here) at the flow outlet side, not having an external threading, can be provided that is used to install the insertion cartridge 5 for example in a standard nozzle.

While the left halves of the longitudinal sections shown in FIGS. 3 and 4 show the installation of the insertion cartridges in an outlet fitting constructed as a molded part, in the right halves of FIGS. 3 and 4 it is shown that these insertion cartridges can also be installed into an outlet fitting constructed at the opening side as a metal tube.

In FIGS. 3 and 4, it is indicated that the intermediate holder 6 in FIG. 3 and the insertion cartridge 5 in FIG. 4 have an end surface at the flow outlet side that is contoured and is formed from projections and recesses 24, this contouring being constructed as a tool engagement surface, for example for a complementarily shaped insertion tool. A standard coin piece can possibly also be used here as an insertion tool.

Figure 5:
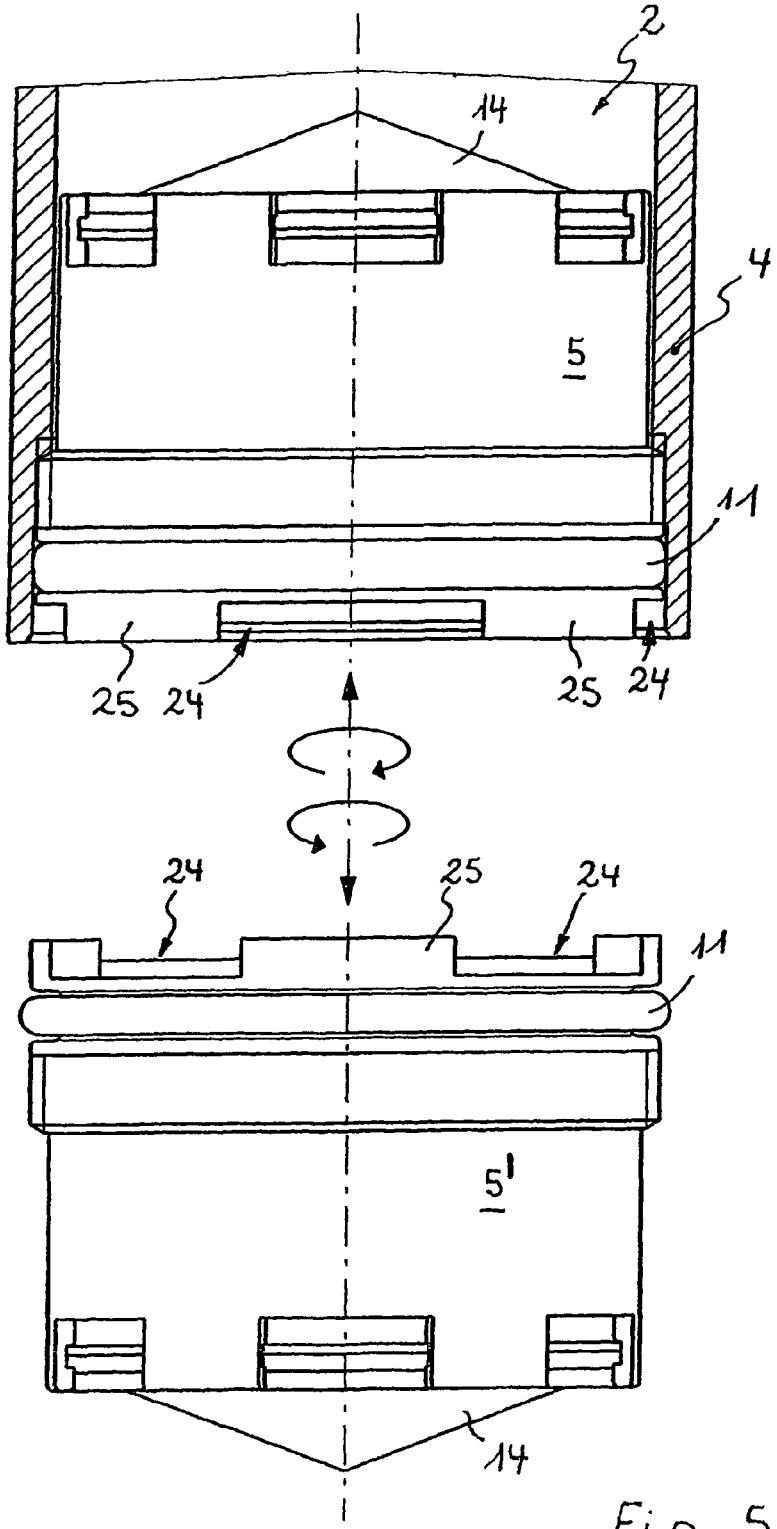
FIG. 5 shows a plumbing outlet fitting having an insertion cartridge that can be placed into the fitting outlet, in which, for the screwing of the insertion cartridge in and out of the fitting outlet, an identically constructed additional insertion cartridge, provided for the exchange, can be used.

In contrast, in FIG. 5 an outlet fitting 1 comparable to that shown in FIG. 4 is shown to which the insertion cartridges 5 are allocated, of which one insertion cartridge 5 is situated in the outlet fitting 1, while an identically constructed different insertion cartridge 5' is provided for exchange. From FIG. 5, it can be seen that the end surface at the outflow side of each insertion cartridge 5, 5' has a contouring formed from projections and recesses 24 on the final edge, in such a way that the recesses 24 of the insertion cartridge 5 held in outlet fitting 1 act as a tool engagement surface for the projections 25 of the other insertion cartridge 5', which can be used here as an insertion tool, and vice versa. The projections 25 and recesses 24 on the outflow end side of the insertion cartridges 5, 5' form in each case a crown-type lower edge whose claws fit into the mating piece that is to be assembled or disassembled.

While in FIG. 5 a complete insertion cartridge 5' is used to exchange the insertion cartridge 5 situated in the outlet fitting 1, it is also possible to use only an additional intermediate holder 6, or only an additional cartridge housing of an insertion cartridge that is otherwise not provided, to unscrew the insertion cartridge 5 situated in the outlet fitting or to unscrew the intermediate holder 6. For this purpose, the manufacturer of the fittings may supply only an additional intermediate holder or only an additional cartridge housing with the fitting, intended for use as an insertion tool. This has the advantage that the fitting manufacturer need not supply a second functional unit that can be installed in the outlet fitting, and the additional intermediate holder or the additional cartridge housing, manufactured and used in relatively large piece numbers, represents a very economical auxiliary tool.

Figure 6:
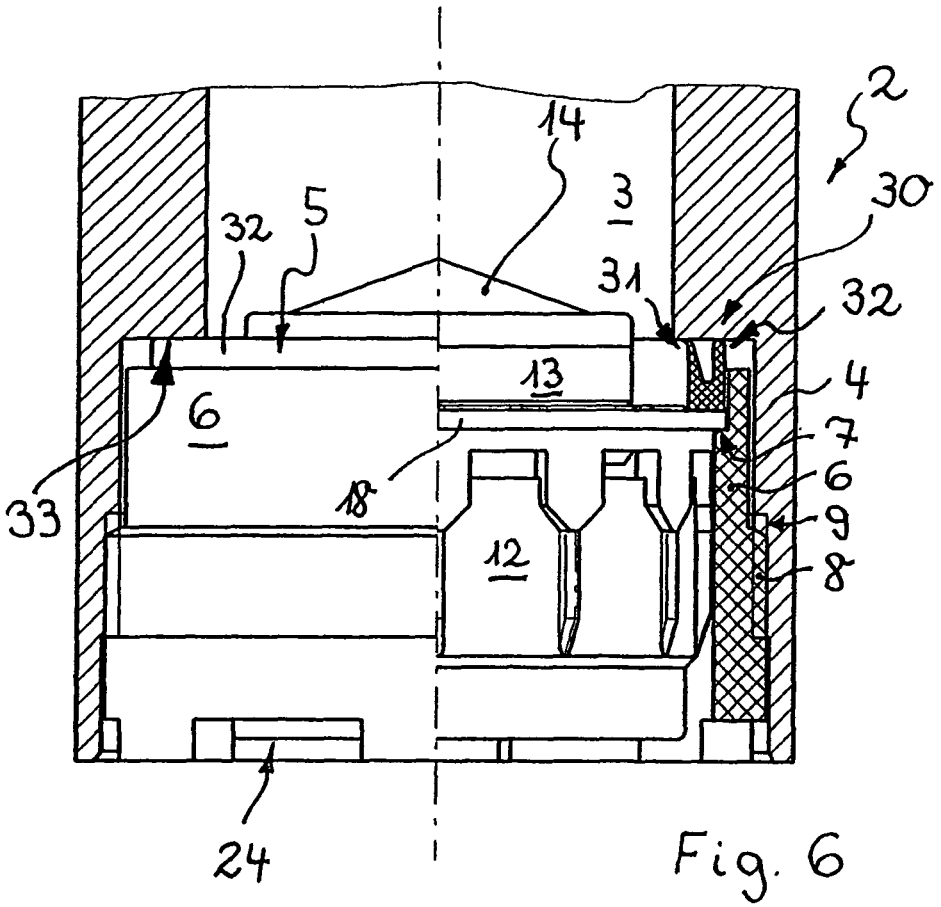
FIG. 6 shows a sanitary outflow armature in whose fitting outlet an insertion cartridge comparable to that shown in FIG. 3 can be removably placed by means of an intermediate holder, such that at the flow inlet side of this insertion cartridge a peripheral seal is formed on in one-piece fashion in order to provide a seal between the insertion cartridge and the intermediate holder on the one hand and the outlet fitting on the other hand.

FIG. 6 shows an outlet fitting 2 into which an insertion cartridge 5 comparable to that shown in FIG. 3 can be placed using an intermediate holder 6. While an annular seal 11 constructed as an O-ring is provided on the intermediate holder 6 shown in FIG. 3, on the insertion cartridge 5 shown in FIG. 6, instead of this, a seal 30 is formed on in one-piece fashion at the flow inlet side. The seal 30, formed on in one piece at the inflow-side final edge area of the cartridge housing, is formed as a sealing profile that has a sealing lip 31 as well as a peripheral external insertion stop 32 situated parallel to the sealing lip. In the position of use of the insertion cartridge 5, the insertion stop 32 limits a deformation of the seal 30 and of its sealing profile. In the position of use, the sealing profile with the sealing lip 31 and its insertion stop 32 work together with an annular projection 33 situated around the inner periphery of the fitting outlet, which limits the clear outlet cross-section of outlet fitting 2. The cartridge housing of the insertion cartridge 5, with the seal 30 formed thereon in one piece, can be manufactured as a single-component or multi-component injection-molded part. For the simple recycling of the materials used for the insertion cartridge and its intermediate holder, it is however useful if the cartridge housing and the seal 30 formed thereon are made of the same, preferably food-safe, material. In this way, the manufacturing outlay is simplified and the tool costs for an injection-molding tool that may be required can be kept relatively low.

As can be seen by comparing FIGS. 3 and 6, the insertion cartridge 5 shown in FIG. 6 is significantly easier to construct, because the additional sieve attachment 15, fashioned in FIG. 3 as a snap ring at the flow inlet side, and annular seals 11 and 17, can be omitted, which is significantly simpler from the point of view of assembly and manufacture.

Figure 7:
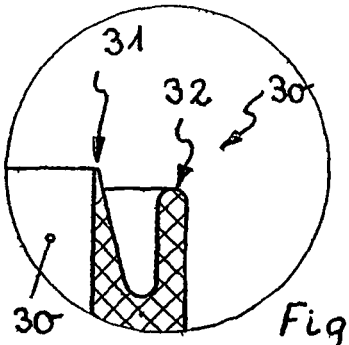
FIG. 7 shows the seal from FIG. 6 in a detailed view in the area of its sealing profile, the sealing profile having a sealing lip and a radially adjacent insertion stop.

The seal 30 from FIG. 6 is shown in FIG. 7 in a detailed longitudinal section.

The sealing lip 31, as well as the outer insertion stop 32 running parallel thereto in peripheral fashion, can be seen clearly.

Figure 9:
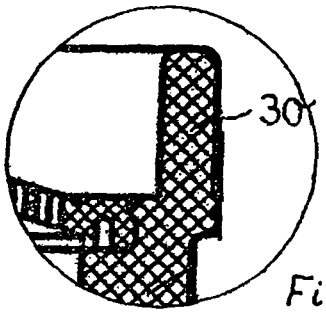
FIG. 9 shows a seal that is functionally comparable to that shown in FIGS. 6 to 8, having a surface seal as a sealing profile.

FIG. 9 shows a modified specific embodiment of the seal 30 whose sealing profile is here constructed as a surface seal.

Figure 8:
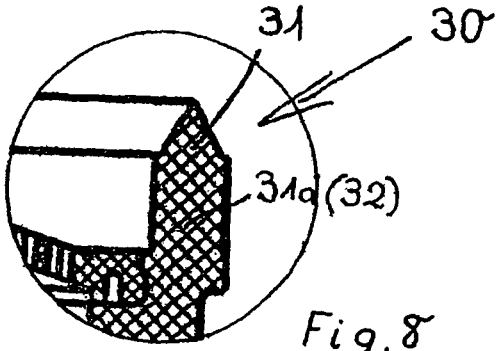
FIG. 8 shows a seal that is functionally comparable to that shown in FIGS. 6 and 7, but having only one sealing lip.

FIG. 8 shows, in contrast, a construction having a single sealing lip 31 that is situated on a sealing profile base 31*a*. The sealing profile base 31*a* here is constructed as the insertion stop 32, which, in the constructions of the seal 30 shown in FIGS. 6 and 7, limits the insertion depth of the insertion cartridge in the outlet fitting.

Figure 10:
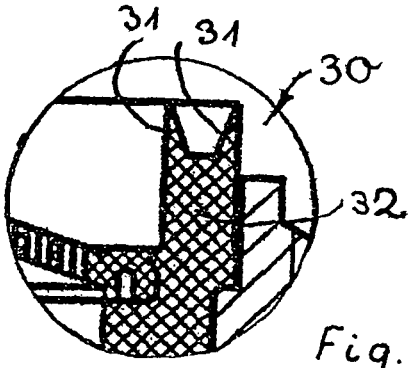
FIG. 10 shows a seal that is functionally comparable to that shown in FIGS. 6 to 9, having two radially adjacent sealing lips with bevels directed opposite one another.
Figure 11:
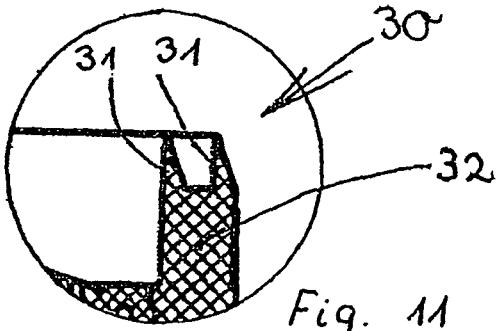
FIG. 11 shows a seal having two radially adjacent sealing lips having bevels in the same direction.

FIGS. 10 and 11 show two constructions of the seal 30, constructed as a sealing profile, each having two sealing lips 31 that are situated in annular peripheral fashion in the final edge area at the flow inlet side of the insertion cartridge. In the seal 30 shown in FIG. 10, the edges of the sealing lips 31 have different bevelings in order to influence the deformation in the position of use. The beveled edges situated opposite one another shown in FIG. 10 have the effect that in the position of use of the insertion cartridge, the sealing lips 31 bend away from one another, and thus can seal even a broad final edge area. FIG. 11 shows two sealing lips 31 each having bevelings on their external side, and which, in the position of use of the insertion cartridge, are thereby bent towards the center of the insertion cartridge.

Figure 12:
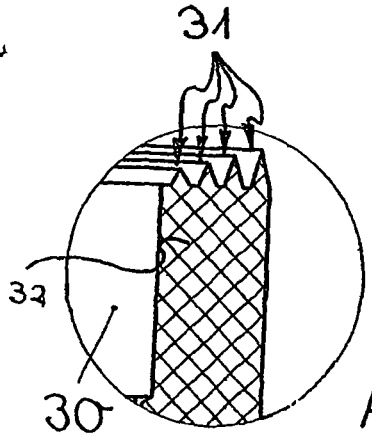
FIG. 12 shows a seal functionally comparable to that shown in FIGS. 6 to 11, having four radially adjacent annular peripheral sealing lips.

FIG. 12 shows an advantageous construction of the seal 30, in which annular peripheral sealing lips 31 that become effective one after the other are provided on the sealing profile base, situated in stepped fashion to one another and having differently stepped heights. The sealing lips 31 become effective one after the other with increasing insertion pressure acting on the insertion cartridge. Here, after extended use of the insertion cartridge, it is possible to maintain the sealing effect over a long period of time by tightening the insertion cartridge and/or the intermediate holder. If the highest sealing lip 31, here situated on the outer peripheral edge, has already become somewhat damaged or worn or inflexible, the sealing lip 31 that is next in height can again achieve the sealing effect after tightening. Moreover, small roughnesses or unevenness of the counterstop in the outlet fitting can be compensated.

Of course, the sealing profiles described on the basis of FIGS. 7 to 12 can be formed in one piece not only onto an insertion cartridge, but also onto an intermediate holder, in particular on the final edge thereof at the flow inlet side.

The plumbing functional units shown here can be inserted into the outlet end of a sanitary outflow armature 1, 2 in such a way that a nozzle that can be screwed onto the outlet end from the outside can be omitted. Because in the outlet fittings shown here a nozzle can be omitted, the gap is also omitted that would otherwise remain between the nozzle and the outlet fitting; this gap would have an adverse effect on the optical appearance of such an outlet fitting and would work against hygienic requirements due to the accumulation of dirt. Because, in the outlet fittings 1, 2 shown here, the insertion cartridge is situated with its entire longitudinal extension completely in the liquid guide of the outlet fitting, the outlet fitting can be given a uniform coloring or chroming without a great expense, without simultaneously also having to give a nozzle or other components the same color or shape. Because the entire inner diameter of the liquid guide provided in the outlet fitting is available for the insertion cartridge, large-surface sieve attachments can also be used, which significantly prolong the useful time between two maintenance intervals. If the insertion cartridge, as shown in FIG. 5, is constructed at its flow outlet side in such a way that an insertion cartridge having an identical construction but intended for exchange can be screwed on and off it, the insertion cartridge can simultaneously also act as a tool for assembly and disassembly.

The invention claimed is:

1. Sanitary outflow armature (1, 2) comprising: a liquid guide (3) that opens into a fitting outlet (4); an insertion cartridge (5) arranged in the fitting outlet (4), wherein an inner diameter of the liquid guide (3) is adapted to the insertion cartridge (5) at least in an opening area of the fitting outlet (4); and a hollow, cylindrical sleeve-shaped intermediate holder (6) that holds the insertion cartridge in a single fixed position and includes an annular groove on the outer face of the sleeve-shaped intermediate holder (6), the annular groove holding an annular seal that provides a seal in the radial direction between the intermediate holder (6) and an inner periphery of the fitting outlet (4).

2. Sanitary outflow armature according to claim 1, wherein the cartridge housing of the intermediate holder (6) has a contoured outlet periphery and/or a contoured outflow end surface, constructed as a tool engagement surface for an insertion tool.

3. Sanitary outflow armature according to claim 2, wherein the outflow end surface of the cartridge housing of the intermediate holder (6) has a contouring made up of projections (25) and recesses (24), such that the recesses (24) of the insertion cartridge (5) held in the intermediate holder (6) acts as a tool engagement surface for the projections (25) of another cartridge housing (5') that can be used as an insertion tool, and/or of another intermediate holder.

4. Sanitary outflow armature according to claim 3, wherein the insertion cartridge (5) is situated with a longitudinal extension thereof completely in the fitting outlet (4) so that only an outflow end surface is directly visible.

5. Sanitary outflow armature according to claim 3, wherein the intermediate holder (6) that can be placed into the fitting outlet from the opening side is held removably or non-removably in the fitting outlet (4).

6. Sanitary outflow armature according to claim 3, wherein the insertion cartridge (5) or intermediate holder (6) can be inserted into the fitting outlet (4) up to an insertion stop.

7. Sanitary outflow armature according to claim 3, wherein the intermediate holder (6) is held in the fitting outlet by at least one of a glued, clamped, locking, and screw connection, and/or by at least one of pressing, clutching, and wedging.

8. Sanitary outflow armature according to claim 3, wherein the intermediate holder (6) is sealed peripherally against an inner peripheral wall of the fitting outlet (4).

9. Sanitary outflow armature according to claim 3, wherein the insertion cartridge (5) is held in the intermediate holder (6) by a clamped, locking, or screw connection.

10. Sanitary outflow armature according to claim 3, wherein the insertion cartridge (5) is sealed against the intermediate holder (6), which is in turn sealed against an inner peripheral wall of the fitting outlet (4).

11. Sanitary outflow armature according to claim 3, wherein the intermediate holder (6) has an outer thread that can be screwed into an inner thread in the fitting outlet (4), and the outer thread and the inner thread are dimensioned and situated such that when the intermediate holder is screwed into the fitting outlet, the threads initially engage one another in a relative position of the Sanitary outflow armature (1) on the one hand and the intermediate holder (6) on the other hand in which the annular seal (11) provided on an outer periphery of the intermediate holder does not yet make frictional contact with the Sanitary outflow armature (1, 2).

12. Sanitary outflow armature according to claim 3, wherein the insertion cartridge (5) and the intermediate holder (6) are connected in one piece with at least one seal (30) that forms a seal between the insertion cartridge (5) and the intermediate holder (6) on the one hand and the Sanitary outflow armature (1, 2) on the other hand.

13. Sanitary outflow armature according to claim 12, wherein the seal (30), and the component of the insertion cartridge (5) and the intermediate holder (6) connected in one piece with the seal (30), are made of the same material.

14. Sanitary outflow armature according to claim 3, wherein at least one of the outflow-side final edge area of the insertion cartridge (5) and of the intermediate holder (6) is fashioned as a sealing profile.

15. Sanitary outflow armature according to claim 14, wherein the sealing profile has at least one surface seal and at least one lip seal.

16. Sanitary outflow armature according to claim 14, wherein the insertion cartridge (5) and/or the intermediate holder (6) has at a flow inlet side an insertion stop (32) that in its position of use limits a deformation of the sealing profile.

17. Sanitary outflow armature according to claim 14, wherein the sealing profile has at least one seal having a sealing profile base that is formed as an insertion stop (32).

18. Sanitary outflow armature according to claim 17, wherein the insertion stop (32) is situated adjacent to the sealing profile in a radial direction.

19. Sanitary outflow armature according to claim 17, wherein at least one of the sealing profile and the insertion stop work together with a counterstop on an inner periphery of the Sanitary outflow armature that limits the inner diameter of the liquid guide.

20. Sanitary outflow armature according to claim 14, wherein the sealing profile has at least one annular peripheral sealing lip (31).

21. Sanitary outflow armature according to claim 14, wherein the sealing profile has at least two annular peripheral sealing lips that become effective one after the other with increasing insertion pressure that acts on the insertion cartridge and/or on the intermediate holder.

22. Sanitary outflow armature according to claim 14, wherein the sealing lips have different heights.

23. Sanitary outflow armature according to claim 14, wherein the sealing lips have stepped heights.

24. Sanitary outflow armature (1, 2) comprising: a liquid guide (3) that opens into a fitting outlet (4); an insertion cartridge (5) arranged in the fitting outlet, wherein an inner diameter of the liquid guide (3) is adapted to the insertion cartridge (5) at least in an opening area of the fitting outlet (4); and a hollow, cylindrical sleeve-shaped intermediate holder (6) that holds the insertion cartridge in a single fixed position and includes an annular groove on the outer face of the sleeve-shaped intermediate holder (6), the annular groove holding an annular seal that provides a seal in the radial direction between the intermediate holder (6) and an inner periphery of the fitting outlet (4), wherein the intermediate holder (6) comprises a contoured end face tool engagement portion.

25. A pluming outlet fitting insertable into a fitting outlet of a sanitary outflow armature, the plumbing outlet fitting comprising: an insertion cartridge (5); and a hollow, cylindrical sleeve-shaped intermediate holder (6) adapted to receive the insertion cartridge, the intermediate holder (6) includes an annular groove on an outer face of the intermediate holder, the annular grove holding an annular seal that provides a seal in the radial direction between the outer periphery of the intermediate holder (6) and an inner periphery of the fitting outlet (4) and a connection for removably holding the intermediate holder (6) in the fitting outlet.

26. Sanitary outflow armature according to claim 24, wherein the cartridge housing of the intermediate holder (6) has a contoured outlet periphery and/or a contoured outflow end surface, constructed as a tool engagement surface for an insertion tool, wherein the outflow end surface of the cartridge housing of the intermediate holder (6) has a contouring made up of projections (25) and recesses (24), such that the recesses (24) of the insertion cartridge (5) held in the intermediate holder (6) acts as a tool engagement surface for the projections (25) of another cartridge housing (5') that can be used as an insertion tool, and/or of another intermediate holder.

27. A pluming outlet fitting according to claim 25, wherein the cartridge housing of the intermediate holder (6) has a contoured outlet periphery and/or a contoured outflow end surface, constructed as a tool engagement surface for an insertion tool, wherein the outflow end surface of the cartridge housing of the intermediate holder (6) has a contouring made up of projections (25) and recesses (24), such that the recesses (24) of the insertion cartridge (5) held in the intermediate holder (6) acts as a tool engagement surface for the projections (25) of another cartridge housing (5') that can be used as an insertion tool, and/or of another intermediate holder.

* * * * *